US005162815A

United States Patent [19]

Hodge

[11] Patent Number: 5,162,815

[45] Date of Patent: Nov. 10, 1992

[54] THERMAL PRINTING APPARATUS WITH TENSIONLESS DONOR WEB DURING PRINTING

[75] Inventor: Donald J. Hodge, Brockport, N.Y.

[73] Assignee: Eastman Kodak Company, Rochester, N.Y.

[21] Appl. No.: 866,290

[22] Filed: Apr. 13, 1992

Related U.S. Application Data

[63] Continuation of Ser. No. 542,502, Jun. 25, 1990, abandoned.

[51] Int. Cl.[5] ..... B41J 17/10

[52] U.S. Cl. ..... 346/76 PH; 400/232; 400/224.1; 400/224.2; 400/225; 400/236; 400/236.2; 400/120

[58] Field of Search ..... 400/232, 235, 235.1, 400/224.1, 224.2, 225, 227, 236, 236.1, 236.2, 120; 346/76 PH

[56] References Cited

U.S. PATENT DOCUMENTS 4,800,399 1/1989 Long et al. ..... 346/76 PH
4,973,985 11/1990 Genno et al. ..... 346/76 PH

FOREIGN PATENT DOCUMENTS 0064130 11/1982 European Pat. Off. ..... 400/232
0234967 10/1987 Japan ..... 400/225

*Primary Examiner*—Benjamin R. Fuller
*Assistant Examiner*—Huan Tran
*Attorney, Agent, or Firm*—Raymond L. Owens

[57] ABSTRACT

A thermal printer includes motor control apparatus for variably controlling the rotational speed of a take-up spool used to wind-up an expended dye-bearing donor web after passage through a print zone. The donor web is moved through the print zone at a substantially constant velocity by a rotatably driven print drum which cooperates with a thermal print head to unwind the donor web from a supply spool. The motor control apparatus operates to rotate the take-up spool at a speed inversely proportional to the instantaneous take-up spool diameter, whereby the expended donor web is accummulated at a rate slightly slower than the rate at which it is payed-out of the print zone during the printing operation. Preferably, the desired rate of rotations of the take-up spool, which gradually decreases with the number of prints made, is determined by the use of a shaft encoder mounted on the support shaft of the supply spool. During the production of thermal prints, the output of such shaft encoder is used to control a variable speed motor which appropriately decreases the rotational velocity of the take-up spool to maintain a zero tension in the web between the print zone and take-up spool. By eliminating tension on the donor web during printing, certain tension-produced artifacts in the thermal print are avoided.

3 Claims, 2 Drawing Sheets

THERMAL PRINTING APPARATUS WITH TENSIONLESS DONOR WEB DURING PRINTING

This is a continuation of application Ser. No. 542,502, filed Jun. 25, 1990, now abandoned.

BACKGROUND OF THE INVENTION

The present invention relates to the field of thermal printing. More particularly, it addresses the technical task of eliminating certain artifacts appearing in thermal prints as a result of variations in the tension of a dye-bearing donor web during the printing operation.

In the thermal printing process, a dye-bearing donor web is brought into contact with a dye-receiving print media at a print zone. Thermal printing is effected by contacting the donor web with a multi-element print head which spans the donor web in a direction transverse to the direction of web travel. The print head typically comprises a linear array of closely spaced resistive elements, each being independently addressable by an applied current to heat that portion of the donor web directly opposite and thereby cause dye to transfer from the donor web to the print media. To maintain intimate contact between the donor web and print media during this printing operation, the donor web and print media are partially wrapped over the surface of a rotatably-driven platen roller, sometimes referred to as a "print drum". The print drum is commonly driven by a precision stepper motor so that the spacing between adjacent image lines can be precisely controlled. Most often, the take-up spool for the donor web is rotatably driven by a far less-expensive DC motor, since its function is simply to accumulate expended donor web. The donor web is supplied by a rotatably mounted supply spool, and a clutching arrangement is used to control the drag on the supply spool so as to prevent free-wheeling of the supply spool under the influence of the take-up spool motor.

In thermal printing apparatus of the above type, it has been observed that the print quality is influenced considerably by tension variations in the donor web during printing. When web-tension varies during printing, an artifact known as "banding" appears in the thermal print. Ideally, the pulling tension exerted on the donor web by the take-up spool should be maintained perfectly uniform throughout the printing cycle. Unfortunately, this ideal is very difficult to achieve, especially when relatively low-cost drive motors are used to effect take-up spool rotation. Also, the diameter of the take-up spool has a variable effect on web tension. As prints are made, the take-up spool diameter gradually increases, thereby altering the web tension.

In the commonly assigned U.S. patent application Ser. No. 504,445 entitled Thermal Printing Apparatus With Tensionless Donor Web During Printing, filed on Apr. 4, 1990 in the name of Stanley W. Stephenson, there is disclosed a thermal printer in which the tension in the donor web downstream of the print zone is reduced to zero during each printing operation. This tensionless condition virtually eliminates the banding artifact and is achieved by rotating the take-up spool at a rate slower than the rate at which the donor web is payed-out from the print zone by a rotatably driven print drum. A two-speed motor is used to rotate the take-up spool at two discrete rates, i.e., a first rate which is sufficiently slow as to produce, during each printing cycle, web slack between the print zone and the take-up spool, and a second rate which is sufficiently fast as to eliminate all web slack between printing cycles.

While the above-noted two-speed motor control apparatus of Stephenson functions well to provide the desired tensionless condition of a donor web in a thermal printer, it is not without limitations. As noted above, the donor web take-up spool gradually increases in diameter as more and more prints are made. The effect of this increase in take-up spool diameter is that the expended donor web is accumulated at an ever-increasing rate, even though the take-up spool rotates at a fixed angular velocity. To assure that a certain minimal slack is provided between the print zone and the take-up spool regardless of the take-up spool diameter, it is necessary to produce considerably more web slack when the take-up spool diameter is at a minimum than when it is at a maximum. Since certain physical constraints within the printer can limit the tolerable amount of web slack, it is necessary to either limit the diameter of the donor web supply and, hence, the maximum diameter of the take-up spool, thereby requiring more frequent interruptions in the printing operation to change the donor web supply and take-up, or to accept a certain amount of artifacts in the prints produced by the end portion of a relatively large donor web supply.

SUMMARY OF THE INVENTION

In view of the foregoing discussion, an object of this invention is to provide a method and apparatus for producing a large number of artifact-free thermal prints without requiring frequent changes of the donor web take-up spool.

According to the method of the invention, the take-up spool used in a thermal printer to accumulate an expended donor web is rotated at a speed proportional to the approximate instantaneous diameter of the take-up spool. According to a preferred embodiment, a signal proportional to such diameter is produced by using a shaft encoder to monitor the number of revolutions of a donor web supply spool from which the donor web is unwound and fed to the print zone.

According to the apparatus of the invention, means are provided for determining the instantaneous diameter of a take-up spool in a thermal printing apparatus and for producing a signal inversely proportional to such spool diameter. Preferably, such means comprises a shaft encoder for monitoring the number of revolutions made by a donor web supply spool from which the donor web is unwound and fed to a print zone of such apparatus. A variable speed motor, operatively coupled to the take-up spool, is responsive to such signal to rotate the spool at a rate equal to or slightly slower than the rate at which the expended donor web is payed-out of the print zone during the printing operation.

The invention and its various objects and advantages will become more apparent to those skilled in the art from the ensuing detailed description of preferred embodiments, reference being made to the accompanying drawings.

DETAILED DESCRIPTION OF PREFERRED EMBODIMENTS

Figure 1:
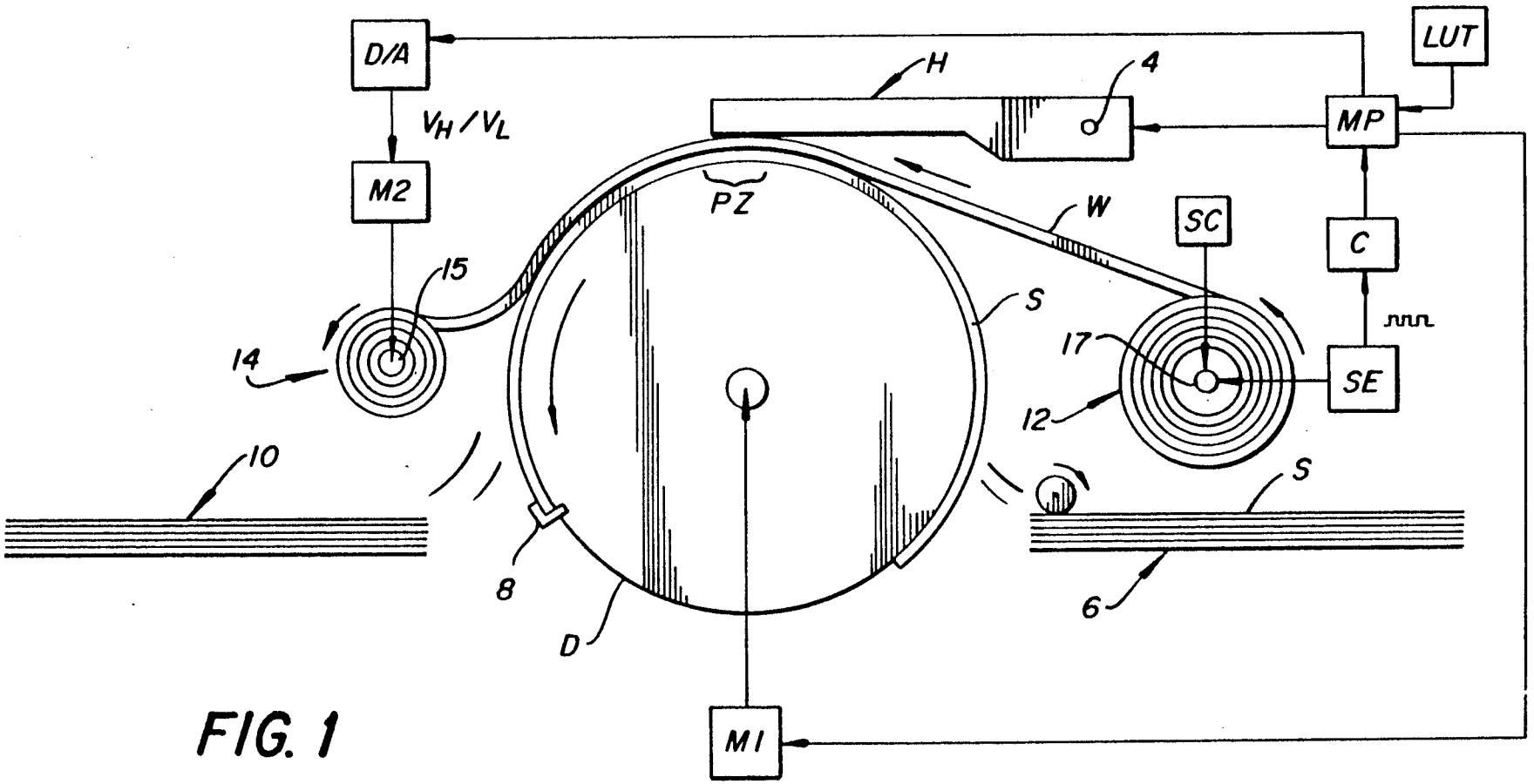
FIG. 1 is a schematic illustration of a thermal printing apparatus embodying the present invention.
Figure 2:
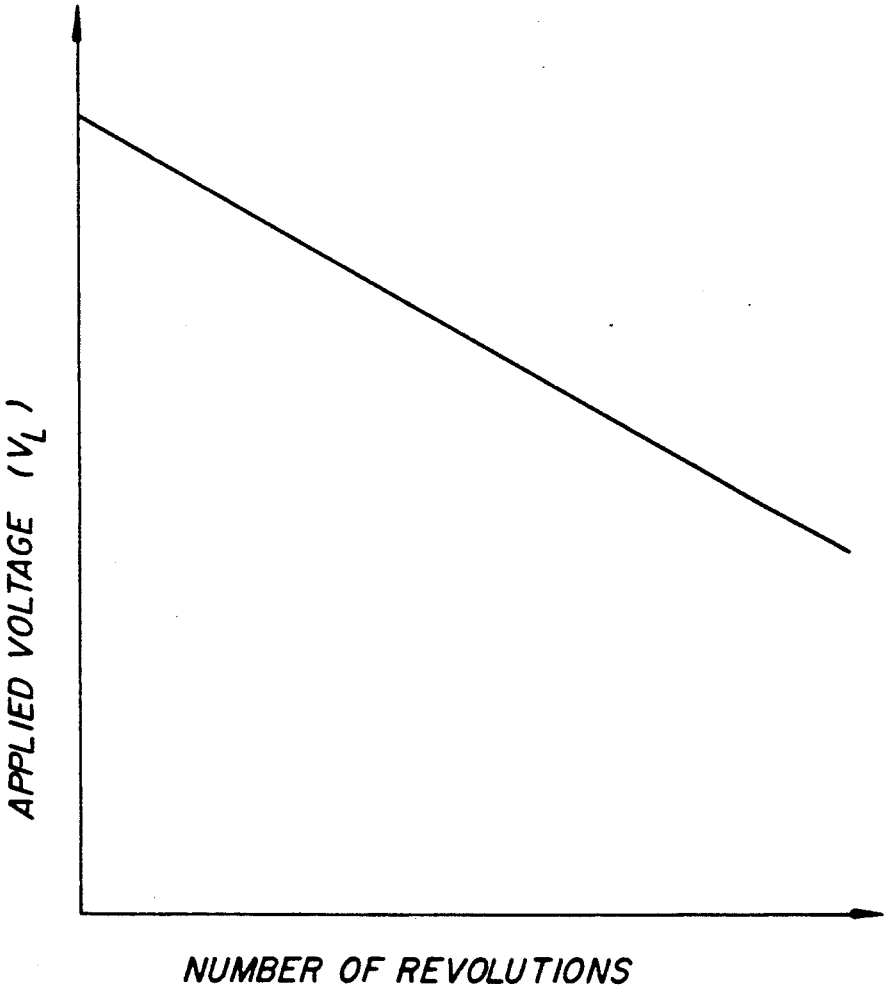
FIG. 2 is a plot of applied motor voltage versus the number of revolutions of the donor web supply spool used in the FIG. 1 apparatus.

Referring now to the drawings, FIG. 1 schematically illustrates a thermal printer embodying the present invention. Such printer generally comprises a rotatably driven cylindrical print drum D which functions to support and transport a print-receiver sheet S through a print zone PZ where it receives thermally printed information. Thermal printing is effected by advancing a dye-bearing donor web W, together with the print receiver sheet, through the print zone, between the print drum and a thermal print head H. The print head is movably mounted, e.g., for pivotal movement about a pivot pin 4, for movement between a printing position (shown in the drawing) in which it presses against the print drum and the media therebetween, and a non-printing position (not shown) in which the print head is spaced from the print drum.

Print head H spans the print drum and is of conventional design, comprising a linear array of closely spaced printing elements, each being independently addressable with image information by an applied voltage provided by a microprocessor MP. As each printing element is addressed, it heats that portion of the donor web directly opposite, thereby causing dye to transfer from the donor web to the print-receiver sheet. By addressing all printing elements simultaneously, an entire line of image information is printed at once. In color thermal printers, the donor web usually comprises spaced-apart patches of cyan, yellow and magenta dyes in a repeating series, and the print-receiver sheet is rotated multiple times through the print zone, once for each color, to receive a full-color image. The print-receiver sheets are fed to the drum from a sheet supply 6 and are clamped to the drum by a suitable clamping mechanism 8. Upon receiving the thermal image, the clamping mechanism releases the print-receiver sheet, allowing it to enter an output tray 10.

Print drum D is rotatably driven by a precision stepper motor M1 which, in turn, is controlled by the output of the microprocessor. The microprocessor also functions to control the position of the print head, selectively moving the head to its non-printing position after printing to allow passage of the clamping mechanism through the print zone, as well as to allow passage of those portions of the drum not bearing a print-receiver sheet.

The dye-bearing donor web W is fed through the print zone from a supply spool 12 to a take-up spool 14. Web W is sufficiently long and has a sufficient number of dye patches to produce, for example, 100 prints. Rotation of the take-up spool is effected by a variable speed motor M2 having a drive shaft 15 to which the take-up spool is keyed for rotation. By a similar keying arrangement, the donor web supply spool is supported for rotation with a shaft 17 which is rotatably mounted within the printer housing. A slip clutch SC exerts a slight backward tension on the donor web to prevent free-wheeling and to eliminate any tendency for the web to wrinkle. As will be appreciated, the diameter of the take-up spool 14 gradually increases during the print-making operation, while the supply spool diameter becomes increasingly smaller.

As mentioned above, it has been observed that whenever a variable tension is applied to the donor web by the supply spool during the printing operation, there is a tendency for the "banding" artifact to appear in the printed image. Such banding is evidenced by high spatial frequency variations in density of the printed image, and is particularly noticeable in solid tones. The banding artifact is particularly noticeable when the web is under high tension in the region between the print zone and the take-up spool.

As noted in the aforementioned U.S. application Ser. No. 504,445, the banding artifact can be substantially reduced by producing a zero-tension condition in the donor web during the printing operation. This condition is achieved during the printing operation by allowing the donor web to be advanced through the printing zone only by the movement of the print drum and by the frictional force exerted on donor web by the print head. That is, during printing, movement of the donor web is not, in any way, assisted by a pulling tension on the web, as might be exerted by take-up spool 14. During printing, the donor web take-up spool is rotated at a rate equal to or, more preferably, slower than the rate at which the donor web is payed-out of the print zone by the rotating print drum. During the printing operation, the web may become slack (as shown) in a direction downstream of the print zone, between the print zone and take-up spool 14. As soon as printing is completed and the print head is moved to its non-printing position, the take-up spool 14 is rotated at a faster rate, a rate sufficient to take up any slack in the donor web produced during the printing operation. As noted above, the slip-clutch SC provides a slight drag on the supply spool sufficient to prevent any substantial free-wheeling of the supply spool during both printing and non-printing cycles.

The take-up spool motor M2 is of a variable speed design which responds to different voltages, shown for the sake of illustration, as a high voltage $V_H$ and a low voltage $V_L$ to rotate the take-up spool at fast and slow speeds, respectively. The voltage applied to motor M2 is provided by a digital-to-analog (D/A) circuit 20 which responds to an output provided by the microprocessor. When a high voltage $V_H$ is applied to motor M2, the take-up spool rotates a rate sufficient to eliminate any slack in the donor web. As noted above, such high voltage is applied when no printing is taking place, and the print head is in its non-printing position, spaced from the print drum. However, whenever printing is occurring, the microprocessor applies a low voltage $V_L$ to motor M2 and, as explained below, such low voltage is variable, depending on the diameter of the take-up spool, in order to maintain the peripheral velocity of the take-up spool substantially constant. Preferably, such peripheral velocity is slightly slower than the peripheral speed of the print drum, whereby a certain amount of web slack is produced during printing.

According to the preferred embodiment of this invention, the desired peripheral speed of the donor web take-up spool 14 is controlled by monitoring the number of revolutions made by the donor web supply spool 12. Since the donor web is tightly wound on the supply spool by the manufacturer, the number of revolutions of the supply spool shaft is a relatively accurate reflection of the amount of donor web passing through the print zone and, hence, the amount of web wound upon the take-up spool. As shown in the drawing, a shaft encoder SE, operatively coupled to the supply spool support shaft 17, operates in a well known manner, to produce a fixed number of pulses for each rotation of the supply spool. Such pulses are counted by a counting circuit C which provides a digital input to the microprocessor representing the number of revolutions of shaft 22 and, hence, the amount of web material that has been advanced to the take-up spool. Experimental data, stored in a look-up table LUT and representing the desired low voltage to be applied to the take-up spool drive motor as a function of total pulse count (for a given web supply and take-up spool) is used by the microprocessor to output a digital signal representing the desired low voltage to be applied to motor M2. Such digital signal is converted to an appropriate analog voltage by the D/A converter. A curve illustrating the relationship between pulse count and the applied low voltage ($V_L$) to the take-up motor M2 is shown in FIG. 3. Values representative of this curve are stored in the look-up table.

From the foregoing description, it will be appreciated that a relatively accurate measure of the take-up spool diameter and, hence, the rate at which the take-up spool accumulates the expended donor web, is provided by monitoring the number of revolutions of the supply spool. By continuously decreasing the rotational speed of the take-up spool as its diameter gradually increases, the aforementioned technical problem associated with a two-speed motor drive is avoided.

The invention has been described in detail with particular reference to certain preferred embodiments thereof, but it will be understood that variations and modifications can be effected within the spirit and scope of the invention.

What is claimed is:

1. A method for producing thermal prints comprising:

unwinding a dye-bearing donor web from a rotating supply spool and advancing such donor web to a print zone at which such web is acted upon by a thermal print head and print drum to transfer dye from the web to a print-receiving medium;

advancing such donor web from the print zone toward a take-up spool by controllably rotating said print drum by a first motor means, said take-up spool having an instantaneous web diameter and being rotatable at a rotational speed;

winding up the advanced donor web on the take-up spool by rotatably driving the take-up spool by a second motor means;

producing a signal proportional to the number of rotations of the supply spool as the web is unwound therefrom; and using such signal to control the rotational speed of the take-up spool so that, while dye is being transferred to the print medium at the print zone, the take-up spool rotates at a speed inversely proportional to the take-up spool diameter and the web is wound upon the take-up spool at a slower rate than said web is paid-out of the print zone to thereby eliminate tension on said web during printing.

2. The apparatus as defined by claim 1 wherein said supply spool has a rotational velocity, and wherein said signal-producing means comprises a shaft-encoder operatively coupled to said supply spool, said shaft-encoder being adapted to provide an output signal in the form of a series of pulses occurring at a rate proportional to the rotational velocity of said supply spool, means for counting said pulses, and means for producing an analog signal proportional to the pulse count.

3. Thermal printing apparatus comprising:

a supply spool having thereon a dye-bearing donor web;

means for rotatably supporting said spool;

a rotatably-driven print drum for unwinding such web from said supply spool and for advancing such web past a thermal print head at a print zone where dye is transferred to a print-receiving medium by said print head, said rotatably-driven print drum causing said supply spool to rotate as it unwinds web therefrom and further causing the web to be paid-out of the print zone at a constant rate;

first motor means for rotating said print drum;

a rotatably-mounted take-up spool for accumulating web paid-out of said print zone;

means for producing a signal proportional to the number of revolutions of said supply spool as web is unwound therefrom; and variable-speed motor means, responsive to said signal, for rotating said take-up spool at a variable rate such that, during printing, the speed of rotation of the take-up spool decreases as donor web is accumulated and the take-up spool accumulates the donor web at a slower rate than the rate at which it is paid-out of said print zone to thereby eliminate tension on said web during printing.

* * * * *